US005608292A

United States Patent [19]

Konopka et al.

[11] Patent Number: 5,608,292

[45] Date of Patent: Mar. 4, 1997

[54] SINGLE TRANSISTOR BALLAST WITH FILAMENT PREHEATING

[75] Inventors: John G. Konopka, Barrington; Dennis L. Stephens, Niles, both of Ill.

[73] Assignee: Motorola, Inc., Schaumburg, Ill.

[21] Appl. No.: 491,016

[22] Filed: Jun. 15, 1995

[51] Int. Cl.[6] ..... H05B 37/02

[52] U.S. Cl. ..... 315/209 R; 315/307; 315/219; 315/247; 315/226; 315/94; 315/DIG. 5

[58] Field of Search ..... 315/209 R, 209 T, 315/219, 205, 247, 226, 291, 307, DIG. 5, DIG. 7, 94, 96, 97, 101, 105, 106

[56] References Cited

U.S. PATENT DOCUMENTS

| | | | |
|---|---|---|---|
| 4,075,476 | 2/1978 | Pitel | 315/209 R |
| 4,109,307 | 8/1978 | Knoll | 315/205 X |
| 4,277,728 | 7/1981 | Stevens | 315/307 |
| 4,392,087 | 7/1983 | Zansky | 315/219 |
| 5,138,235 | 8/1992 | Sun et al. | 315/209 R |
| 5,144,195 | 9/1992 | Konopka et al. | 315/94 |
| 5,399,944 | 3/1995 | Konopka et al. | 315/219 |

*Primary Examiner*—Robert Pascal
*Assistant Examiner*—Haissa Philogene
*Attorney, Agent, or Firm*—Gary J. Cunningham

[57] ABSTRACT

A ballast circuit for driving a gas discharge having a source of pulsating and rectified AC (20), an energy storage circuit (30), a switch (40) that can have one end connected to an energy storage inductor and an opposite end that can be connected to circuit common; a control circuit (50) for opening and closing the switch (40) at a rate that is a function of at least a DC control current, a resonant circuit (60) that is coupled to the energy storage circuit (30) for energizing the gas discharge lamp.

18 Claims, 2 Drawing Sheets

SINGLE TRANSISTOR BALLAST WITH FILAMENT PREHEATING

TECHNICAL FIELD

This invention relates to the general subject of electronic ballasts used to operate gas discharge lamps and, in particular, but not exclusively, to a single transistor ballast with filament preheating.

BACKGROUND OF THE INVENTION

Fluorescent lamps are increasingly used because of their high efficiency in converting electrical energy into light. Ballasts are used to operate gas discharge lamps by supplying controlled power to heat a lamp's cathodes or filaments and to supply sufficient starting or striking voltage to ionize the gas and establish an arc between the lamp's filaments.

One important class of ballasts is the "rapid start" ballast. In a rapid start ballast, filament or cathode voltage is first applied before striking an arc through the lamp, which takes about 750 milliseconds. This mode of operation provides optimum performance and best lamp life based on number of cold starts. One such ballast is disclosed in U.S. Pat. No. 5,144,195 to Konopka et. al. and assigned to the assignee of the present invention. In that patent a ballast is disclosed wherein filament heating is controlled by delaying the boost startup with respect to the lamp drive inverter. The inverter starts immediately when power is applied and the boost starts about 700 milliseconds later. Until the boost starts, the inverter has insufficient voltage output to strike the lamps. During this time the output voltage is sufficient to heat the filaments. When the boost comes on, the voltage to the inverter rises, lamp voltage rises and the lamps are struck.

A more modern ballast is disclosed in U.S. Pat. No. 5,399,944 to Konopka et. al. and assigned to the assignee of the present invention. U.S. Pat. No. 5,399,944 discloses a "one transistor" ballast. That ballast comprises an energy storage circuit, a power transistor switch that is operated in response to an oscillator and a resonant circuit that couples the energy storage circuit to the fluorescent lamp. Only one power transistor is used for the entire operation of the circuit, compared to two or three transistors that are used in ordinary power factor corrected ballasts. Not only is the cost of manufacture reduced but also the ballast's energy storage capacitors operate at a voltage just slightly less than the peak of the line voltage. This is advantageous compared to many other ballast circuits that require energy storage capacitors to operate at voltages well above the peak of line voltage.

Although the "single transistor" ballast represents an important development in the art, further improvements can be made. In particular, it would be highly desirable to improve lamp life by providing for pre-heating of the lamp filaments before striking the arc through the lamp.

DETAILED DESCRIPTION

Figure 1:
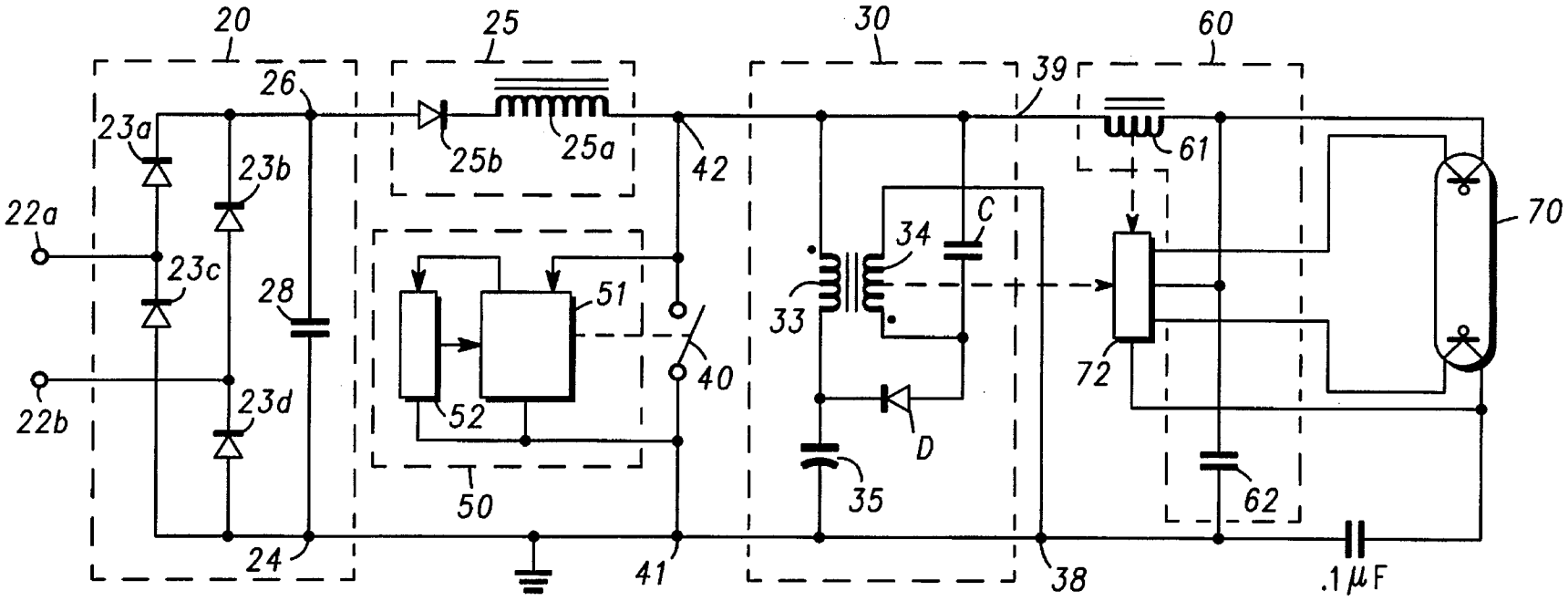
FIG. 1 is a diagram of the ballast that is the subject of the present invention.

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to any specific embodiment so described.

Referring to the drawings, FIG. 1 is a block diagram of the ballast 10 that is the subject of the present invention. In particular, the ballast 10 comprises a power source 20 of pulsating and rectified AC, an energy storage circuit 30, a switch 40, a switch control circuit 50 for opening and closing the switch, a resonant circuit 60 that is coupled to the energy storage circuit for energizing the gas discharge lamp 70. Also shown in the diagram is a power factor correction circuit 25 and a lamp filament heating circuit 72.

The ballast 10 can provide: pre-heating of the filaments of a fluorescent lamp; an improved single transistor ballast; a means for dimming a fluorescent lamp that is driven by a single transistor ballast; and for preheating the filaments of a fluorescent lamp that is driven by a single transistor ballast.

Turning to the power source 20, a set of terminals 22*a* and 22*b* is provided for connecting to a supply of low frequency AC power, such as a 60 Hz, 120V AC power line. Rectifier diodes 23*a*, 23*b*, 23*c* and 23*d* convert the incoming sinusoidal waveform into a full wave, pulsating rectified voltage between a common terminal 24 and a positive output terminal 26. A capacitor 28 prevents high frequency noise from the circuit operation escaping onto the power lines and acts as a low impedance source of current for the power factor correction circuit. A network of small inductors (e.g., in series with the AC source) may be included to further reduce the noise to the desired level.

The power switch 40 has two switch terminals. One switch terminal is connected to a circuit common node 41. The other switch terminal is connected to a node 42 at the junction between a power factor correction inductor 25*a* and the energy storage circuit 30. This node 42 is thereby periodically connected to the common terminal 41 with a frequency (e.g., about 30 KHz) determined by the switch control circuit 50. The power switch 40 may consist of any kind of high frequency device, such as, for example, a bipolar transistor, field effect transistor, thyristor, insulated gate bipolar transistor, or a vacuum tube device.

The power switch 40 is connected to the full wave rectified AC power at the positive terminal 26 through a power factor correction inductor 25*a* and a diode 25*b*. This diode 25*b* is oriented so that power will not return to the power source 20 from the energy storage circuit 30. When the power switch 40 is "on" or closed, current builds up linearly with time through the power factor correction inductor 25*a*, charging it with current in proportion to the incoming voltage. The energy stored by the power factor correction inductor 25*a* is proportional to the square of the current through it. Therefore, this inductor 25*a* when periodically switched by power switch 40, causes energy to be drawn from the power source 20 in an amount that is proportional to the square of the voltage, just as would result from the connection of a resistor. The current drawn from the power line is thus in phase with and proportional to the voltage, resulting in a good power factor.

In the embodiment shown in FIG. 1, energy storage circuit 30 comprises an energy storage inductor that is formed by a primary winding 33 and clamping winding 34. Primary winding 33 and clamping winding 34 have similar physical characteristics. Primary winding 33 has first and second primary winding terminals. The first primary winding terminal of primary winding 33 is connected to power switch 40. The second primary winding terminal of primary winding 33 is connected to an energy storage capacitor 35. The other side of the energy storage capacitor 35 is connected to circuit common 41. The clamping winding 34 has one end connected to circuit common 41 and an opposite end that is connected by means of an auxiliary capacitor C to the power switch 40 and by means of a diode D to the second primary winding terminal.

While the power switch 40 is turned on, current is drawn from the energy storage capacitor 35 through primary winding 33. This current builds up linearly in the same manner as the current through the power factor correction inductor 25*a*. In this manner, energy is transferred from capacitor 35 to the primary winding 33. Detailed operation of the energy storage circuit 30 is described in U.S. Pat. No. 5,399,944 to Konopka et. al., the disclosure of which is incorporated herein by reference.

The voltage at the junction node 42 consists of a square wave which is alternately zero when the power switch 40 is "on" and twice the voltage across capacitor 35 when the power switch 40 is "off". The voltage across the output of the energy storage circuit 30 is therefore also a square wave. The output of the energy storage circuit 30 is obtained across two output nodes 38 and 39. The resonant circuit 60, consisting of a series inductor 61 and capacitor 62, is located across the output terminals 38 and 39 of the energy storage circuit 30.

Resonant circuit inductor 61 (e.g., 3.35 mH) and resonant capacitor 62 (e.g., 0.0068 μF) resonate at a frequency slightly higher than that at which power switch 40 is cycled. The lamp load 70 is placed across the resonant capacitor 62 so that an AC current flows through the resonant inductor 61 and through the lamp load 70. The higher the voltage rises on the energy storage capacitor 35, the more current flows through the lamps, drawing additional power from energy storage capacitor 35 until equilibrium is reached.

In the operation of the circuit, the voltage at the junction node 42 is clamped by the energy storage circuit 30 so that at times when the incoming line voltage is highest, energy is stored in the energy storage capacitor 35. At times when the power line voltage is low or zero, energy is drawn from the energy storage capacitor 35 and converted into current in the energy storage windings 33 and 34. Since the energy storage capacitor 35 runs with a voltage close to the peak of the line, the voltage that is presented to the power factor correction inductor 25*a* at the junction node 42 is approximately twice the peak of the line. When the power switch is running with 50% duty cycle, this results in a near unity power factor for the impedance that the system presents to the AC power line.

Figure 2A:
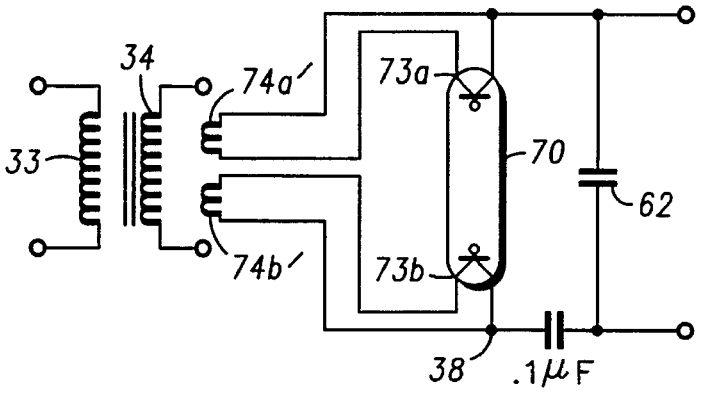
FIGS. 2A and 2B are schematic diagrams of two embodiments of the lamp filament heating circuit shown in FIG. 1.
Figure 2B:
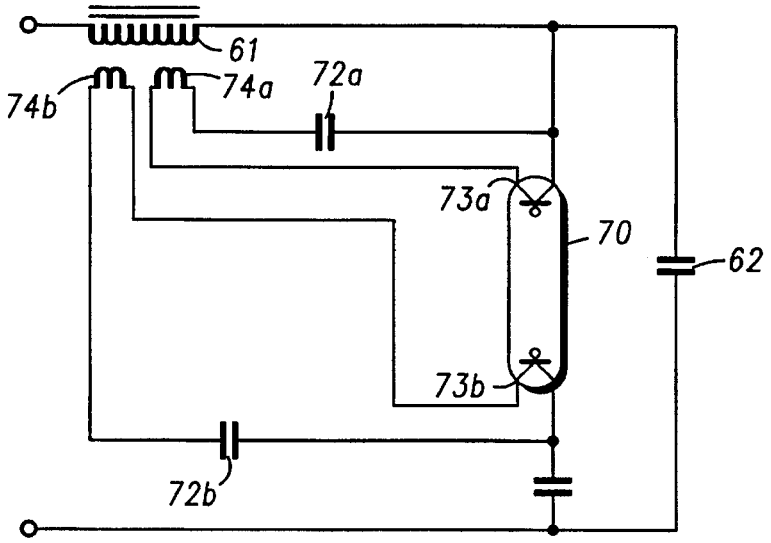

In this design, one way to prevent an arc from striking after the ballast 10 is energized, is to shift the operating frequency away from resonance. This has the effect of lowering the output voltage to a point below the lamp strike potential. The filament voltage will not be affected by this frequency shift if it is derived from the energy storage inductors 33 and 34 (see FIG. 2A) or the resonant circuit inductor 61 (see FIG. 2B), since these inductors are not affected by the frequency change. If a dimming feature is desired, the voltage applied to heat the lamp filaments 73*a* and 73*b* is preferably obtained from the resonant circuit inductor 61 (see FIG. 2B), since it is more sinusoidal. Capacitors 72*a* and 72*b* (e.g., about 0.33 μF) are preferably used to connect the windings 74*a* and 74*b* (just a few turns) that supply power to heat the filaments 73*a* and 73*b* from the resonant circuit inductor 61.

Figure 3:
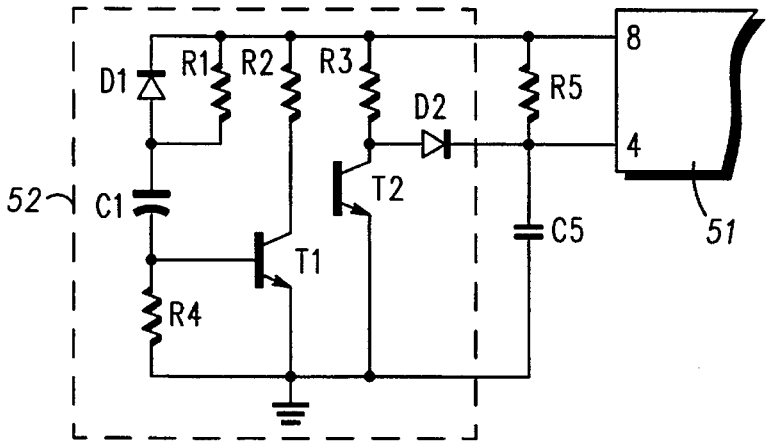
FIG. 3 is a schematic diagram of the current changing circuit shown in FIG. 1.

Turning to FIG. 3, the power switch 40 is operated in response to the control circuit 50. In one embodiment, the switch control circuit 50 comprises an integrated circuit (IC) using pulse width modulation (PWM) control (e.g., a current-mode control integrated circuit 51 of the type MC2845, available from Motorola Semi-conductor Products Sector). That IC has eight circuit connections or pins: a COMP output (pin 1), a VFB input (pin 2), a current sense input (pin 3), a frequency control or RT/CT input (pin 4), a GND input (pin 5) for connecting to a ground voltage rail (i.e., circuit common 24), a control signal output (pin 6) for operating the power switch, a Vcc input (pin 7), and a VREF output (pin 8). A detailed explanation of the operation of a very similar IC in the context of a lamp ballast is found in U.S. Pat. No. 5,144,195 that is assigned to the assignee of the present invention and that is incorporated herein by reference. Other devices exist and should be familiar to those skilled in the art.

Referring again to FIG. 3, the reference voltage VREF output of the control IC 51 provides a convenient and well-regulated voltage source for controlling the operation of the IC while starting the ballast. When power is applied to the power source 20 of the ballast 10, the IC is energized and the reference voltage VREF output is at 5 volts. This output (pin 8 of the IC) is used with a resistor R5 and a capacitor C5 to provide a current source for the frequency control input of the IC (i.e., the RT/CT input, pin 4) and to power a time delay operated switching circuit 52. The function of this switching circuit is to change the level or flow of the DC control current into the frequency control input of the IC.

In FIG. 3, the time delay operated switching circuit 52 comprises two transistors T1 and T2 that perform as electronic switches and that function together to temporarily increase the current applied to the RT/CT input of the IC 51. In particular, the two transistor switches are connected in such a manner that when the first transistor T1 turns "off," the second transistor T2 is turned "on" and completes a path that diverts current from flowing into the RT/CT input of the IC.

More specifically, when the IC 51 is energized, current flows through two input resistors R1 (e.g., about 4.7 kOhm) and R4 (e.g., about 10 kOhm) to charge a time delay capacitor C1 (e.g., about 100 μF). As long as this capacitor C1 is charging, a voltage is developed across the input resistor R4 that is connected across the first transistor's T1 base input. This resistor R4, the time delay capacitor C1 and the other resistors R1 and R2 that bias the first transistor switch T1, are selected to turn "off" the first transistor after a pre-determinable time delay. As long as the first transistor T1 is "on," the base input and the emitter of the second transistor T2 are grounded and the second switch is "off." The current path from the voltage source or reference VREF passes through a resistance network comprising two resistors R3 (that is in series with a diode D2) and R5 which are in parallel with each other. Full current flows to the RT/CT input (pin 4) of the IC. The size of this parallel resistor R3 (e.g., about 6.8 kOhm) is selected to cause the output frequency of the IC to be high enough above resonance to prevent the lamp load from striking while heating the lamp's filaments.

After a time interval, that is determined, in part, by the size of the time delay capacitor C1, current flow through the first transistor's T1 base resistor R4 drops low enough that the first transistor turns "off." When the first transistor T1 turns "off," it no longer grounds the base of the second transistor T2. Thereafter, due to the current flowing through the input resistor R2 and into the base of the second transistor T2, the second transistor turns "on". This shunts to ground the current flowing through the parallel resistor R3 and reverse biases the diode D2 in series with that resistor. Now, the current path from the voltage source VREF to the frequency control RT/CT input (pin 4) of the IC 51 passes only through one resistor R5. Since this current is lower, the output frequency of the IC returns to the desired resonance frequency, which is determined by the resistor R5 and the capacitor C5 connected to the frequency control RT/CT input (pin 4) of the IC 51. After the power switch control operates at the desired resonance frequency, an arc is struck to light the lamp load 70.

In one embodiment, the ballast circuit comprises: a power source, connected to an alternating current supply, of a pulsating and rectified voltage; an energy storage capacitor having two ends with one end connected to a circuit common; an energy storage inductor having one terminal that is connected to the power source and having a second terminal that is connected to the other end of the energy storage capacitor; a switch that has one end connected to the first terminal of the energy storage inductor and an opposite end that is connected to circuit common; a control circuit for opening and closing the switch at a rate that is a function of at least a DC control current; a resonant circuit that is coupled to the energy storage inductor for energizing the gas discharge lamp and that is characterized by a resonant frequency that is achieved when the DC control current is at a predetermined DC level; and a current changing circuit for changing the DC control current after connecting the alternating current supply such that the switch operates at a rate to achieve resonance only after a pre-determined delay.

In one embodiment of the invention, the current changing circuit comprises a time delay circuit characterized by a predetermined time interval, a startup switch that opens and closes in response to the time delay circuit, and a resistance network that produces the DC control current from a voltage reference and that has a node connected to circuit common through the startup switch, such that the DC control current changes in response to the operation of the time delay circuit permitting the lamp's elements to be heated before the lamp is lighted.

One important advantage of the invention is that the life of the lamp is improved. Another important advantage is that a dimming feature can be added by providing a manual control for changing the frequency of the resonant circuit after the lamp is lighted.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made in the size and arrangement of parts. Moreover, equivalent elements may be substituted for those illustrated and described. For example, the invention was described with reference to an integrated circuit control available from Motorola Semi-conductor (i.e., the MC2845). Other similar devices are available and their operation is understood to those skilled in the art. Also certain features of the invention may be used independently of other features of the invention. For example, once the lamps are lighted, the frequency control pin (i.e., pin 4) of the IC may be used to dim the lamps. By increasing the current flowing to this pin, the output frequency can be raised high enough to move the resonance circuit 60 away from resonance. A simple manual control comprising a pot or variable resistor may be used. The effect is that of changing the current flowing through R3 in the previous description.

Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

We claim:

1. A ballast circuit for driving a gas discharge lamp, comprising:

a power source, connected to an alternating current supply, of a pulsating and rectified voltage;

an energy storage capacitor having two ends with one of said ends connected to a circuit common;

an energy storage inductor having a first terminal that is connected to said power source and having a second terminal that is connected to the other end of said energy storage capacitor;

a switch that has one end connected to said first terminal of said energy storage inductor and an opposite end that is connected to said circuit common;

a resonant circuit that is coupled to said energy storage inductor for energizing the gas discharge lamp, said resonant circuit having a predetermined resonant frequency;

a switch control circuit for opening and closing said switch at a rate that is a function of at least a DC current level; and a current changing circuit comprising a resistor switching circuit for changing said predetermined DC current level for a predetermined time interval after connecting said alternating current supply such that said resonant circuit operates at a frequency that is different than said predetermined resonant frequency for at least said predetermined time interval.

2. The ballast circuit of claim 1, wherein said switch control circuit has a reference voltage output and a frequency control input, and wherein said current changing circuit comprises: a resistance that is connected between said voltage output of said switch control circuit and said frequency control input of said switch control circuit and a circuit for changing said resistance after said predetermined delay.

3. The ballast circuit of claim 1, wherein the gas discharge lamp has a heating element for starting the lamp, and further including a filament heating circuit that is coupled to one of said energy storage inductor and said resonant circuit and that is adapted to be removably connected to said heating element of the gas discharge lamp.

4. The ballast circuit of claim 3, wherein said resonant circuit comprises an inductor; and wherein said filament heating circuit comprises:

at least one winding that is transformerably coupled to said inductor of said resonant circuit; and a capacitor that is in series with said at least one winding.

5. The ballast circuit of claim 1, further including: a clamping winding that is series connected to a clamping diode, said series combination of said clamping diode and said clamping winding being connected in parallel with said energy storage capacitor; and an auxiliary capacitor having one end connected to said first terminal of said energy storage inductor and having an opposite end connected to the junction between said clamping winding and said clamping diode.

6. A ballast circuit for driving a gas discharge lamp, comprising:

a power source, connected to an alternating current supply, of a pulsating and rectified voltage;

an energy storage capacitor having two ends with one of said ends connected to a circuit common;

an energy storage inductor having a first terminal that is connected to said power source and having a second terminal that is connected to the other end of said energy storage capacitor;

a switch that has one end connected to said first terminal of said energy storage inductor and an opposite end that is connected to said circuit common;

a resonant circuit that is coupled to said energy storage inductor for energizing the gas discharge lamp, said resonant circuit having a predetermined resonant frequency;

a switch control circuit for opening and closing said switch at a rate that is a function of at least a DC current level; and a current changing circuit for changing said DC current level after connecting said alternating current such that said switch operates at a rate to achieve resonance only after a predetermined delay, said current changing circuit comprising:

a time delay circuit having a predetermined time interval;

a transistor switch that opens and closes in response to said time delay circuit; and a resistance network for producing said DC current level from a reference voltage, said resistance network having a first node that is connected to said reference voltage, having a second node connected to said switch control circuit and having a third node that is connected to a circuit common through said transistor switch, such that said DC current level changes in response to the operation of said time delay circuit.

7. The ballast circuit of claim 6, wherein said resistance network comprises: a first resistor connected between said first node and said second node; and a series circuit comprising a second resistor and a diode, said series circuit being connected between said first node and said second node, and said second resistor and said diode being connected together at said third node.

8. The ballast circuit of claim 6, wherein said time delay circuit comprises: a transistor that operates in response to an RC-circuit that is connected to said voltage reference such that said transistor is biased-on during the charging of a capacitor.

9. A ballast circuit for driving a gas discharge lamp, comprising:

a power source, connected to an alternating current supply, of a pulsating and rectified voltage;

an energy storage capacitor having two ends with one of said ends connected to a circuit common;

an energy storage inductor having a first terminal that is connected to said power source and having a second terminal that is connected to the other end of said energy storage capacitor;

a switch that has one end connected to said first terminal of said energy storage inductor and an opposite end that is connected to said circuit common;

a resonant circuit that is coupled to said energy storage inductor for energizing the gas discharge lamp, said resonant circuit having a predetermined resonant frequency;

a switch control circuit for opening and closing said switch at a rate that is a function of at least a DC current level; and a current changing circuit for changing said DC current level after connecting said alternating current such that said switch operates at a rate to achieve resonance only after a predetermined delay, said current changing circuit comprising a resistance network for producing said DC current level from a reference voltage, said resistance network having a first node that is connected to said reference voltage, having a second node that is connected to said control circuit and having a third node that is connected to a circuit common through a transistor switch, such that said current level changes in response to the operation of said time delay circuit.

10. The ballast circuit of claim 9, wherein said switch control circuit comprises an integrated circuit having a pulse width modulated output for controlling said opening and closing of said switch, having a reference voltage output and a current controlled input.

11. The ballast circuit of claim 10, further including a capacitor connected between said circuit common and said current controlled input.

12. A ballast circuit for using an AC power source to operate a gas discharge lamp of the type having at least one heating element therein, comprising:

a power circuit for converting the AC power source to a pulsating, rectified, power-factor corrected output;

an energy storage inductor circuit that is connected to said output of said power circuit and that comprises a clamping winding and a primary winding having one of its ends connected to said output of said power circuit;

an electronic switch that connects a circuit common to said one end of said primary winding and that operates in response to a DC control current;

a storage capacitor connected between the other end of said primary winding and said circuit common;

a resonant circuit that is connected to said energy storage inductor circuit and that energizes the gas discharge lamp; said resonant circuit having a resonant frequency that is achieved when said DC control current is at a predetermined DC level; and a starting circuit for changing said DC control current level for a predetermined time interval before operating said resonant circuit at resonance, said starting circuit comprising a switching circuit for supplying a control current that is higher than said predetermined DC level and for supplying a control current equal to said predetermined level at the end of said predetermined time interval.

13. The ballast circuit of claim 12, wherein said starting circuit comprises:

a time delay circuit having said predetermined time interval;

a startup switch that opens and closes in response to the said time delay circuit; and a resistance network for producing said DC control current level from a reference voltage, said resistance network having one end that is connected to said reference voltage and an opposite end that is connected to a circuit common through said startup switch, such that said DC control current changes in response to the operation of said time delay circuit.

14. The ballast circuit of claim 13, wherein said resistance network comprises: two resistors in parallel with each other, one of said two resistors being connected between said reference voltage and said startup switch.

15. The ballast circuit of claim 13, wherein said time delay circuit comprises: a common emitter circuit having a base input; and an RC-circuit that is connected to said reference voltage and to said base input of said common emitter circuit.

16. The ballast circuit of claim 12, wherein said resonant circuit comprises an inductor; and further including: a lamp filament heating circuit that is coupled with said resonant circuit inductor and that is adapted to be removably connected to at least one heating element of the gas discharge lamp for rapidly starting the lamp, said lamp filament heating circuit comprising: at least one winding that is transformerably coupled to said resonant circuit inductor; and a capacitor that is in series with said at least one winding and said at least one heating element.

17. The ballast circuit of claim 16, wherein said energy storage inductor circuit is connected to said output of said power circuit by a series circuit comprising: a power factor correction inductor and a diode that is oriented to stop power from returning to said power circuit.

18. A ballast circuit for using an AC power source to operate a gas discharge lamp of the type having heating element therein, comprising:

a power circuit for converting the AC power source to a pulsating, rectified, power-factor corrected output;

an energy storage inductor circuit that is connected to said output of said power circuit, said energy storage inductor circuit comprising: a primary winding having one end connected to said output of said power circuit and having an opposite end connected to a circuit common through an energy storage capacitor, a clamping winding having a first clamping winding terminal that is connected to said circuit common and having a second clamping winding terminal that is connected through a clamping diode to said opposite end of said primary winding, and an auxiliary capacitor that is connected between said second clamping winding terminal and said one end of said primary winding;

an electronic switch that connects a circuit common to said one end of said primary winding;

a control for opening and closing said electronic switch in response to a DC control current;

a resonant circuit that is connected to said one end of said primary winding and that energizes the gas discharge lamp, said resonant circuit having a resonant frequency that is achieved when said DC control current is at a predetermined DC level; and a starting circuit for changing said DC control current for a predetermined time interval after energizing said power circuit, said starting circuit comprising: a time delay capacitor, a startup switch that opens and closes in response to the voltage across said time delay capacitor, and a resistance network that produces said DC control current from a reference voltage and that has a node connected to said circuit common through said startup switch, such that said DC control current changes at least in response to the operation of said startup switch.

* * * * *